US005896684A

United States Patent [19]

Lin

[11] Patent Number: 5,896,684

[45] Date of Patent: Apr. 27, 1999

[54] DETACHABLE TOE STRAP AND ANKLE STRAP MOUNTING ARRANGEMENT FOR A SIMPLE SHOE

[75] Inventor: Ghing Yi Lin, Taichung, Taiwan

[73] Assignee: Gnan-Jang Plastics Co., Ltd., Taichung, Taiwan

[21] Appl. No.: 09/063,730

[22] Filed: Apr. 24, 1998

[51] Int. Cl.[6] ..... A43B 3/12; A43B 3/24

[52] U.S. Cl. ..... 36/101; 36/11.5

[58] Field of Search ..... 36/100, 101, 11.5

[56] References Cited

U.S. PATENT DOCUMENTS

| | | |
|---|---|---|
| 2,368,314 | 1/1945 | Marx . |
| 3,902,259 | 9/1975 | Cracco . |
| 4,172,330 | 10/1979 | Kao . |
| 4,300,294 | 11/1981 | Riecken . |
| 4,869,000 | 9/1989 | York, Jr. . |
| 5,339,543 | 8/1994 | Lin . |

*Primary Examiner*—Ted Kavanaugh
*Attorney, Agent, or Firm*—Bacon & Thomas, PLLC

[57] ABSTRACT

A detachable toe strap and ankle strap mounting arrangement for a simple shoe, the arrangement includes at least one pairs of locating members, each locating member having a plug hole and a serrated constraint tongue in the plug hole, at least one pair of mounting strips detachably connected to the locating members, each mounting strip having a transverse insertion slot at the top, and at least one downwardly extended, serrated plug strip at the bottom for plugging into the plug hole on one locating member for engagement with the corresponding serrated constraint tongue, and at least one strap fastened to the at least one pair of mounting strips for securing at least one part of the user's foot to the sole of the shoe, each strap having two ends respectively inserted through the insertion slots on one pair of mounting strips and fixedly secured thereto by stitches, and a pin kept in a hole thereon, the pin being used for insertion into the plug hole on one locating member to disengage the respective serrated plug strip from the respective serrated constraint tongue.

1 Claim, 5 Drawing Sheets

DETACHABLE TOE STRAP AND ANKLE STRAP MOUNTING ARRANGEMENT FOR A SIMPLE SHOE

BACKGROUND OF THE INVENTION

The present invention relates to a detachable toe strap and ankle strap mounting arrangement for a simple shoe, and more particularly to such an arrangement which enables the user to set the shoe into a sandal or a slipper.

A regular slipper is generally comprised of a sole, and a toe strap fastened to the sole. When making a sandal, an additional ankle strap is added to the sole. Conventionally, the toe strap and the ankle strap are fastened to the sole by stitches. This stitching operation must be operated by skilled persons. Further, the stitches wear out quickly with use, and the protruded portions of the stitches make the user feel uncomfortable. In recent years, press sealing techniques have been intensively used to fasten a toe strap or ankle strap to a sole. According to these techniques, insertion holes made on the sole, then the ends of the toe strap or ankle strap are respectively inserted into the insertion holes, and the ends of the toe strap or ankle strap are sealed to the sole by a press. However, this mounting process is still complicated. Furthermore, when a toe strap and an ankle strap are fastened to a sole to form a sandal, the ankle strap cannot be detached from the sole to change the sandal into a slipper.

SUMMARY OF THE INVENTION

The present invention has been accomplished under the circumstances in view. It is one object of the present invention to provide a detachable toe strap and ankle strap mounting arrangement which enables the user to detachably and fasten the toe strap and the ankle strap to the sole, so as to arrange the shoe into a slipper or a sandal as desired. It is another object of the present invention to provide a detachable toe strap and ankle strap mounting arrangement which enables the user to change the toe strap and ankle strap of the shoe. According to one aspect of the present invention, the detachable toe strap and ankle strap mounting arrangement comprises at least one pairs of locating members, each locating member having a plug hole and a serrated constraint tongue in the plug hole, at least one pair of mounting strips detachably connected to the locating members, each mounting strip having a transverse insertion slot at the top, and at least one downwardly extended, serrated plug strip at the bottom for plugging into the plug hole on one locating member for engagement with the corresponding serrated constraint tongue, and at least one strap fastened to the at least one pair of mounting strips for securing at least one part of the user's foot to the sole of the shoe, each strap having two ends respectively inserted through the insertion slots on one pair of mounting strips and fixedly secured thereto by stitches. According to another aspect of the present invention, the locating members are embedded in the sole during the molding of the sole. According to still another aspect of the present invention, a pin is kept in a hole on each strap, the pin being used for insertion into the plug hole on one locating member to disengage the respective serrated plug strip from the respective serrated constraint tongue, so that each strap can be conveniently disconnected from the respective locating members.

DETAILED DESCRIPTION OF THE PREFERRED EMBODIMENT

Figure 1:
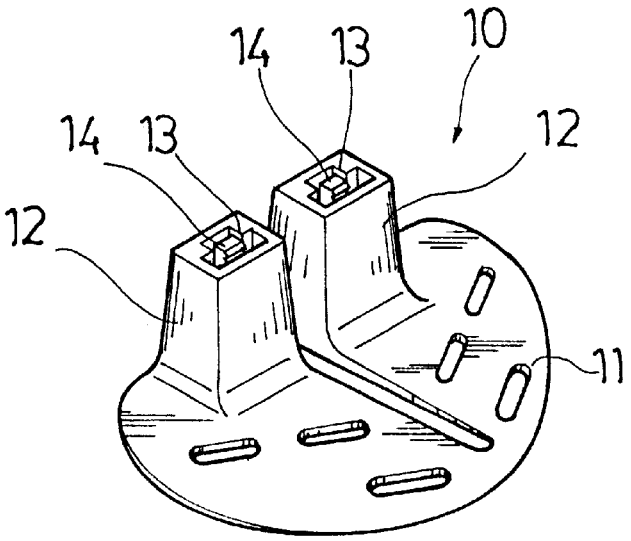
FIG. 1 is a perspective view of a locating member according to the present invention.
Figure 2:
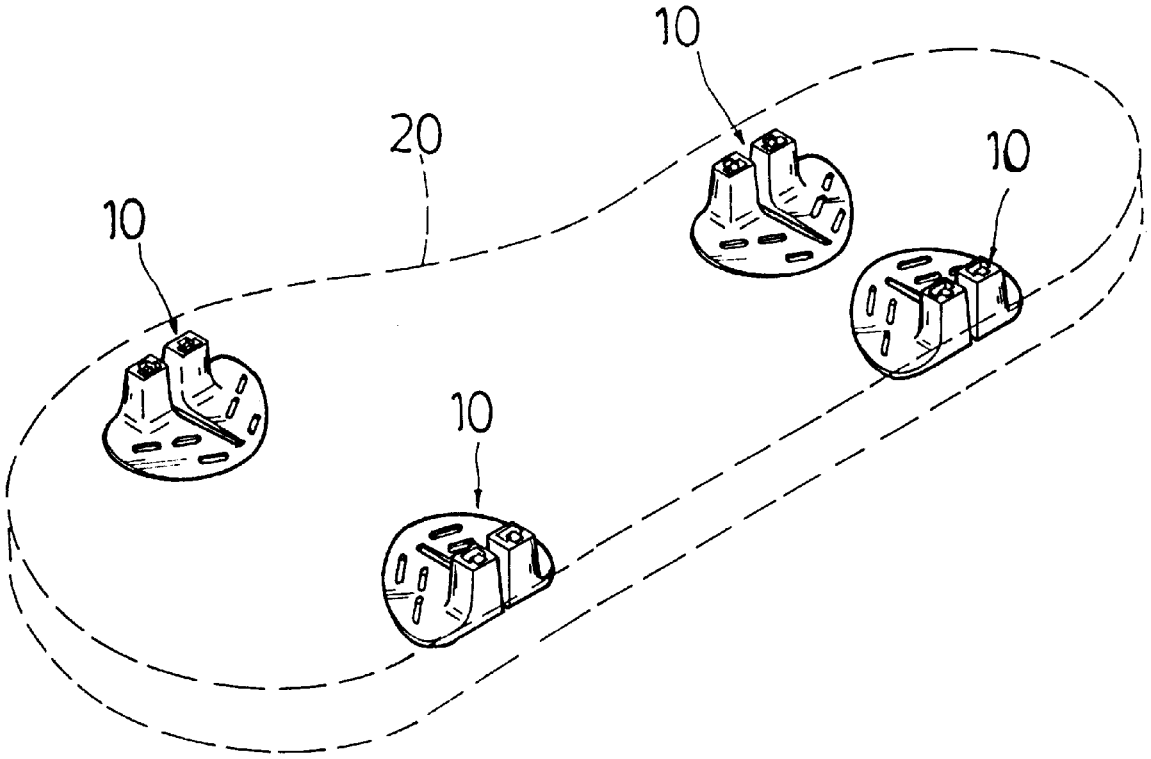
FIG. 2 shows the locating members embedded into the sole according to the present invention.
Figure 3:
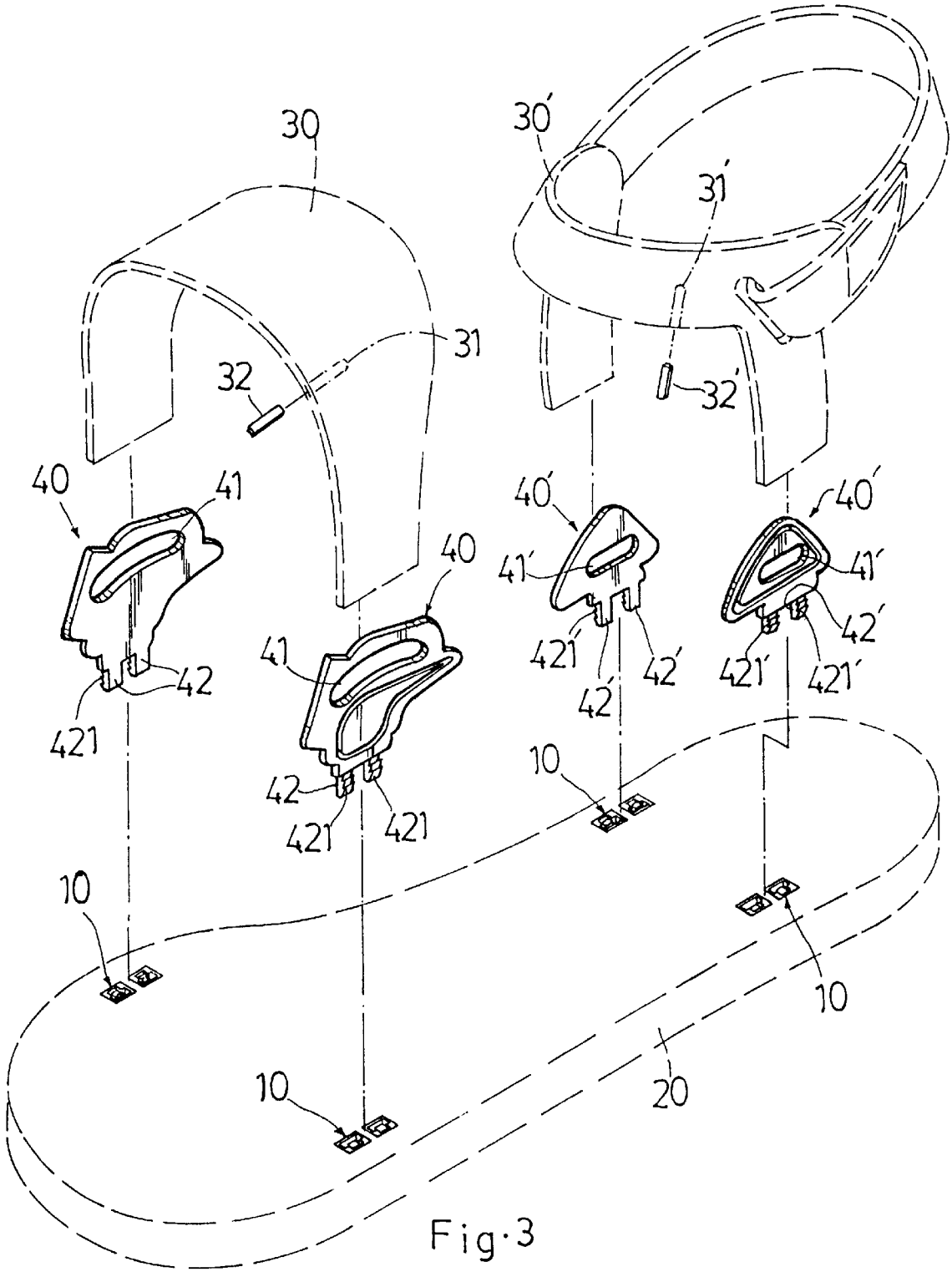
FIG. 3 is an exploded view of the present invention.

Referring to figures from 1 to 7, the present invention comprises two pairs of locating members 10 embedded in a sole 20, a pair of first mounting strips 40, a pair of second mounting strips 40' respectively fastened to the locating members 10, a toe strap 30 connected between the pair of first mounting strips 40, and an ankle strap 30' connected between the pair of second mounting strips 40'.

Referring to FIGS. 1, 2, 3 4 and 5A again, each locating member 10 comprises a flat mounting base 11, and two upright coupling blocks 12 raised from the flat mounting base 11. Each upright coupling block 12 comprises a longitudinal plug hole 13, and a constraint tongue 14 suspending in the longitudinal plug hole 13. The constraint tongue 14 has a fixed end integral with the peripheral wall of the longitudinal plug hole 13, a free end extending upwards to the orifice of the longitudinal plug hole 13, and a plurality of transverse teeth 141 vertically spaced at an outer side. The transverse teeth 141 respectively slope downwards.

The sole 20 is directly molded on the locating members 10. During the molding process of the sole 20, the locating members 10 are put in the upper die with the upright coupling blocks 12 facing upwards. When the upper die and the bottom die are closed, material for sole is filled in the mold that is heated to a predetermined temperature. After molding and setting, the sole 20 is integral with the locating members 10, and the locating members 10 are embedded in the sole 20 with the orifices of the plug holes 13 disposed in flush with the top side wall of the sole 20.

Figure 6:
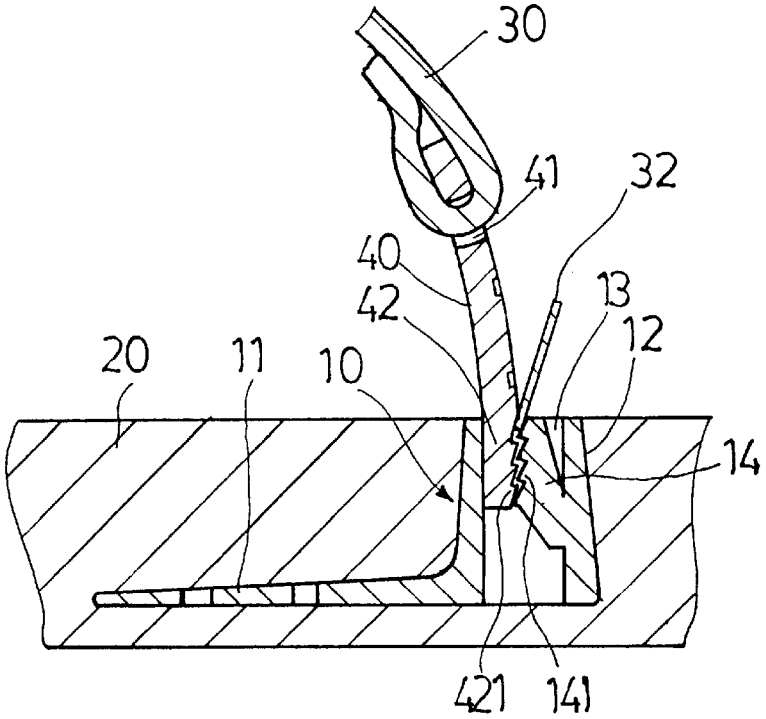
FIG. 6 is similar to FIG. 5A but showing a pin inserted into the plug hole, the transverse teeth of the plug strips disengaged from the transverse teeth of the respective constraint tongues.

Each mounting strip 40 or 40' comprises a transverse insertion slot 41 or 41' near the top for mounting the toe strap 30 or ankle strap 30', and two downwardly extended plug strips 42 at the bottom for plugging into the plug holes 13 on the upright coupling blocks 12 of one locating member 10. Each plug strip 42 has a plurality of transverse teeth 421 vertically spaced at an outer side. The transverse teeth 421 respectively slope upwards. When the plug strips 42 of one mounting strip 40 or 40' are plugged into the plug holes 13 on the upright coupling blocks 12 of one locating member 10, the transverse teeth 421 of the plug strips 42 pass over the transverse teeth 141 of the respective constraint tongues 14, enabling the plug strips 42 to be inserted into position. When the plug strips 42 are pulled upwards, the transverse teeth 421 of the plug strips 42 are forced into engagement with the transverse teeth 141 of the respective constraint tongues 14, and therefore the mounting strip 40 is stopped from escaping out of the plug holes 13 on the upright coupling blocks 12 of corresponding locating member 10 (see FIG. 6).

The ends of the toe strap 30 and the ankle strap 30' are respectively inserted through the insertion slots 41;41' on the respective mounting strips 40;40', and then fixedly secured thereto by stitches. Further, the toe strap 30 and the ankle strap 30' each have a hole 31 or 31', which receives a pin 32 or 32'. The pin 32 or 32' can be taken out of the hole 31 or 31', and inserted into the plug hole 13 on one upright coupling block 12 to disengage the transverse teeth 421 of the respective plug strip 42 from the transverse teeth 141 of the respective constraint tongue 14.

Figure 4:
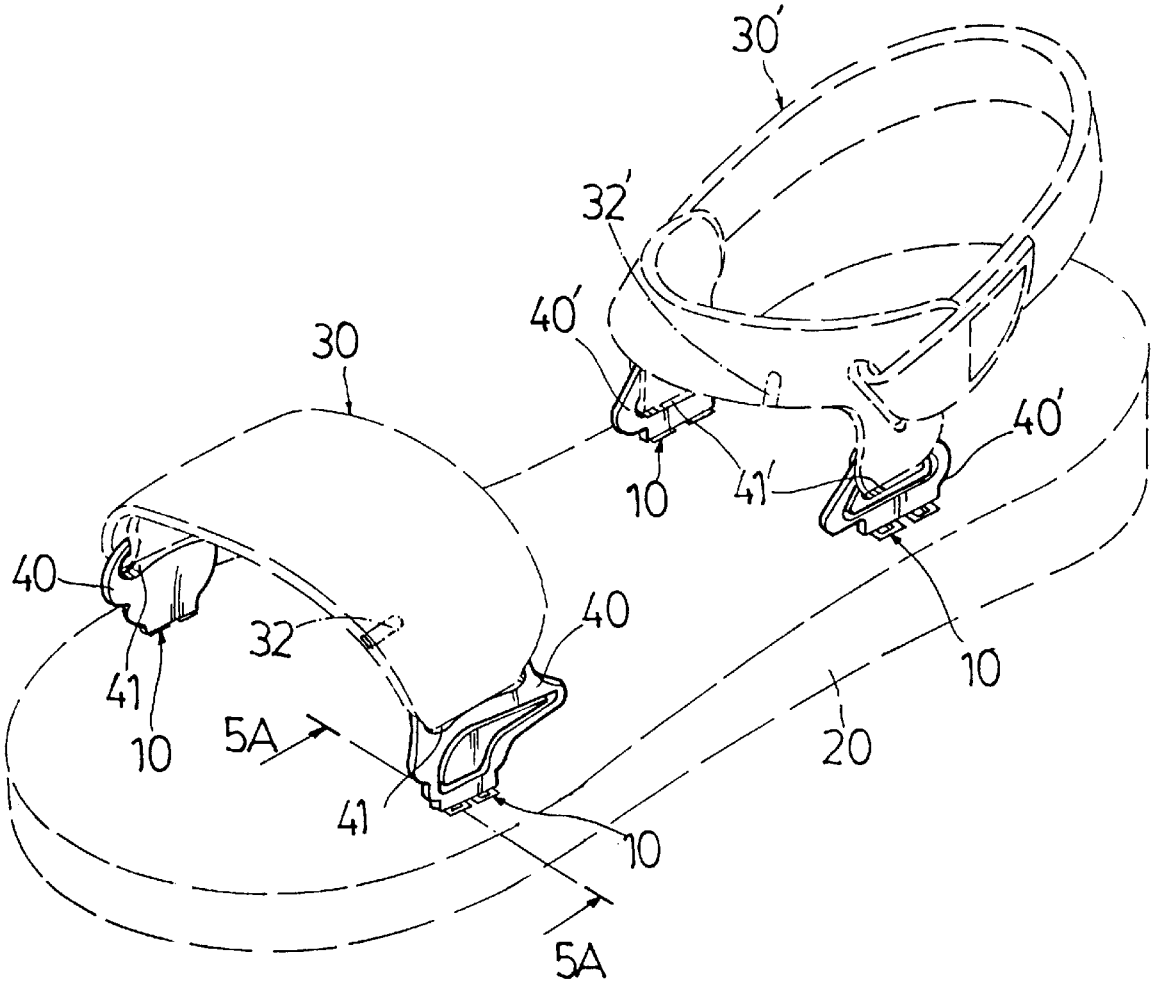
FIG. 4 is a perspective view showing the present invention arranged into a sandal.
Figure 5A:
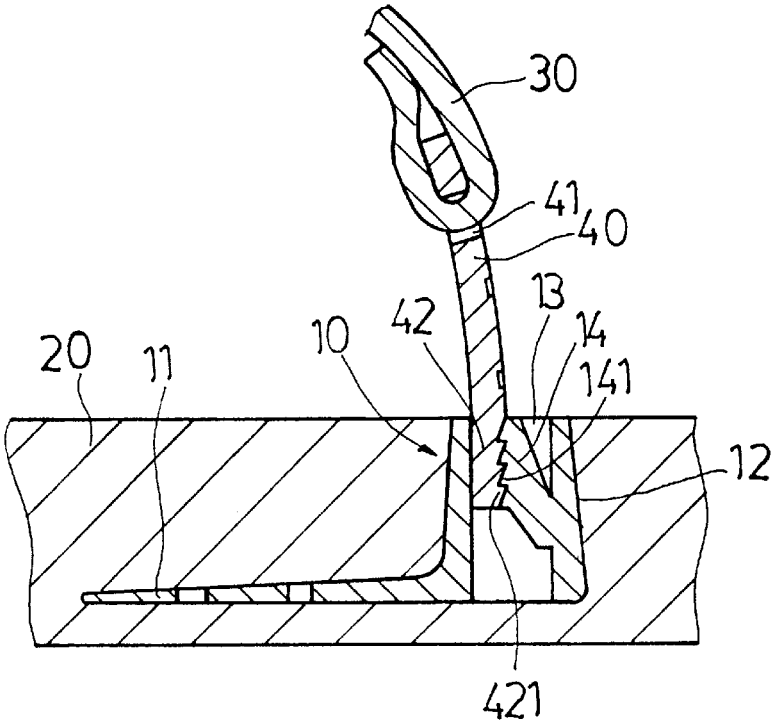
FIG. 5A is a sectional view taken along line 5A—5A of FIG. 4.
Figure 7:
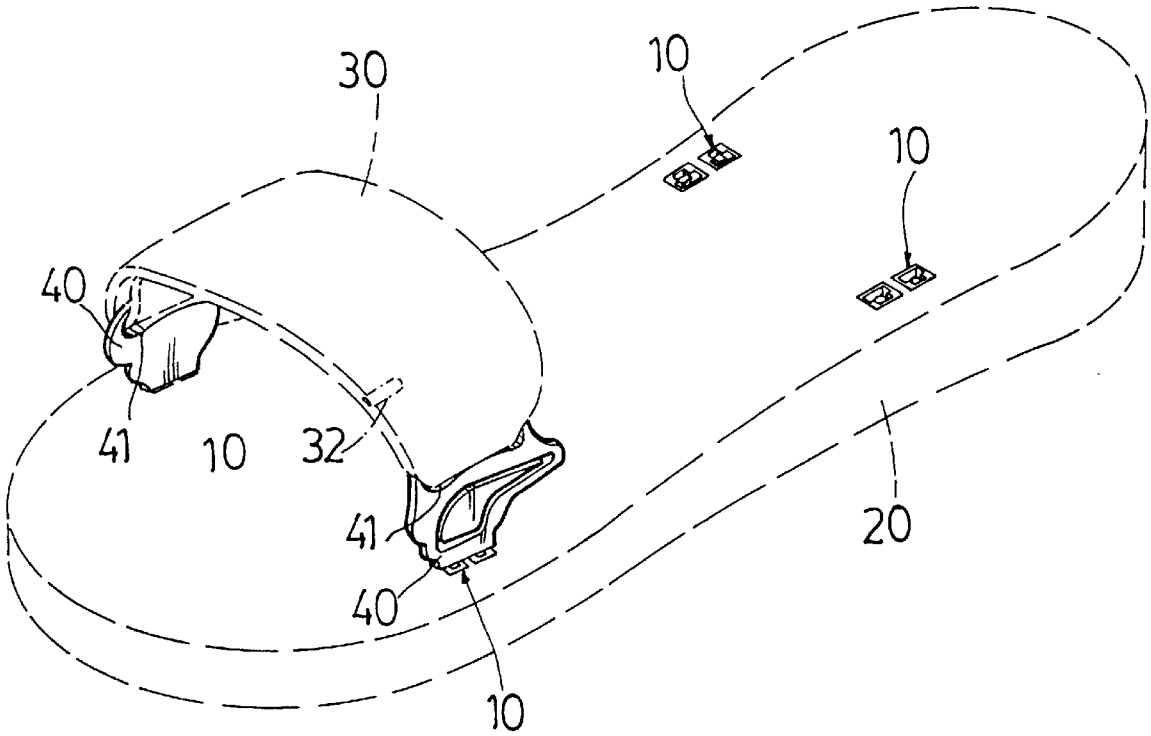
FIG. 7 is a perspective view showing the present invention arranged into a slipper.

By means of the aforesaid arrangement, the user can fasten the toe strap 30 to the sole 20 to form slipper as shown in FIG. 7. Alternatively, the user can fasten the toe strap 30 and the ankle strap 30' to the sole 20 to form a sandal as shown in FIG. 4.

What the invention claimed is:

1. A detachable toe strap and ankle strap mounting arrangement for a shoe, the arrangement comprising:

at least one pair of locating members bilaterally embedded in a sole of the shoe, said locating members each comprising a flat mounting base, and at least one upright coupling block raised from said flat mounting base, said upright coupling blocks each comprising a longitudinal plug hole, and a serrated constraint tongue suspending in said longitudinal plug hole;

at least one pair of mounting strips, said mounting strips each comprising a transverse insertion slot at a top side, and at least one downwardly extended, serrated plug strip at a bottom side for plugging into the plug hole on the upright coupling block of said at least one pair of locating members for engagement with the corresponding serrated constraint tongue; and at least one strap fastened to said mounting strips for securing at least one part of the user's foot to the sole, said at least one strap each comprising two ends respectively inserted through the insertion slot on one pair of said at least one pair of mounting strips and fixedly secured thereto by stitches, a hole, and a pin kept in the hole, said pin being used for insertion into the plug hole on the upright coupling block of said at least one pair of locating members to disengage the respective serrated plug strip from the respective serrated constraint tongue.

* * * * *